US012274388B2

(12) United States Patent
Issack et al.

(10) Patent No.: US 12,274,388 B2
(45) Date of Patent: Apr. 15, 2025

(54) PACKAGE STORAGE ASSEMBLY

(71) Applicants: Khalif Issack, Seattle, WA (US); Adan Abdul, Seattle, WA (US)

(72) Inventors: Khalif Issack, Seattle, WA (US); Adan Abdul, Seattle, WA (US)

( * ) Notice: Subject to any disclaimer, the term of this patent is extended or adjusted under 35 U.S.C. 154(b) by 232 days.

(21) Appl. No.: 18/136,682

(22) Filed: Apr. 19, 2023

(65) Prior Publication Data

US 2024/0349924 A1 Oct. 24, 2024

(51) Int. Cl.
*A47G 29/14* (2006.01)
*A47G 29/30* (2006.01)

(52) U.S. Cl.
CPC ..... *A47G 29/141* (2013.01); *A47G 29/30* (2013.01); *A47G 2029/143* (2013.01); *A47G 2029/149* (2013.01); *A47G 2200/226* (2013.01)

(58) Field of Classification Search
CPC ..... A47G 29/141; A47G 29/30; A47G 2029/143; A47G 2029/149; A47G 2200/226
See application file for complete search history.

(56) References Cited

U.S. PATENT DOCUMENTS

| | | | | |
|---|---|---|---|---|
| 10,424,143 | B2 | 9/2019 | Miller | |
| D927,820 | S | 8/2021 | Gokcebay | |
| 11,103,096 | B1 | 8/2021 | Parr | |
| 11,468,393 | B1 | 10/2022 | Kalathil | |
| 2006/0122852 | A1 | 6/2006 | Moudy | |
| 2017/0124510 | A1 | 5/2017 | Caterino | |
| 2020/0410797 | A1* | 12/2020 | Gomez Santamaria | G07C 9/00912 |
| 2021/0142277 | A1* | 5/2021 | Fee | G07C 9/00571 |
| 2021/0225104 | A1* | 7/2021 | Gokcebay | G07C 9/00896 |
| 2022/0044506 | A1* | 2/2022 | Dewey | G07C 9/215 |
| 2022/0122393 | A1* | 4/2022 | Park | G07C 9/00571 |
| 2022/0170989 | A1* | 6/2022 | Froissart | G07C 9/00309 |
| 2022/0225810 | A1 | 7/2022 | Mack | |
| 2022/0338658 | A1 | 10/2022 | Soderberg | |
| 2023/0012772 | A1* | 1/2023 | Kalathil | A47G 29/30 |

FOREIGN PATENT DOCUMENTS

| | | |
|---|---|---|
| WO | WO2017079006 | 5/2017 |

* cited by examiner

*Primary Examiner* — Sisay Yacob

(57) ABSTRACT

A package storage assembly includes a battery of lockers positioned in a public location to be accessible to delivery drivers and intended recipients. Each of the battery of lockers includes a door and a lock and a communication unit is integrated into the battery of lockers. The communication unit is in communication with the lock in the door associated with each of the battery of lockers. The communication unit receives a delivery command from an extrinsic communication network originating from a respective one of the plurality of personal electronic devices and the communication unit subsequently assigns a respective one of the battery of lockers to the respective personal electronic device. The communication unit communicates an unlock code via the extrinsic communication network to the respective personal electronic device when the communication unit receives the delivery command.

7 Claims, 4 Drawing Sheets

PACKAGE STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to package storage devices and more particularly pertains to a new package storage device for storing a package delivery until an intended recipient can retrieve the package. The device includes a battery of lockers and a communication unit integrated into the battery of lockers to facilitate personal electronic devices to remotely communicate with the battery of lockers to facilitate a delivery driver to deposit a packet in a respective one of the battery of lockers which cannot be unlocked until the intended recipient communicates a pre-determined unlock code to the communication unit.

(2) Description of Related Art Including Information Disclosed Under 37 CFR 1.97 and 1.98

The prior art relates to package storage devices which typically involve a single locked storage cabinet that is in wireless communication with a personal electronic device via an extrinsic communication network to facilitate an intended recipient to retrieve a package that was deposited by a delivery person and a battery of storage lockers that are in communication with a remote computer system. In no instance does the prior art disclose a battery of lockers that are not only located in a public location but is also in wireless communication with a public communication network to facilitate anyone with a personal electronic device to order and subsequently employ a storage locker to retrieve a package delivery.

BRIEF SUMMARY OF THE INVENTION

An embodiment of the disclosure meets the needs presented above by generally comprising a battery of lockers positioned in a public location to be accessible to delivery drivers and intended recipients. Each of the battery of lockers includes a door and a lock and a communication unit is integrated into the battery of lockers. The communication unit is in communication with the lock in the door associated with each of the battery of lockers. The communication unit receives a delivery command from an extrinsic communication network originating from a respective one of the plurality of personal electronic devices and the communication unit subsequently assigns a respective one of the battery of lockers to the respective personal electronic device. The communication unit communicates an unlock code via the extrinsic communication network to the respective personal electronic device when the communication unit receives the delivery command.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
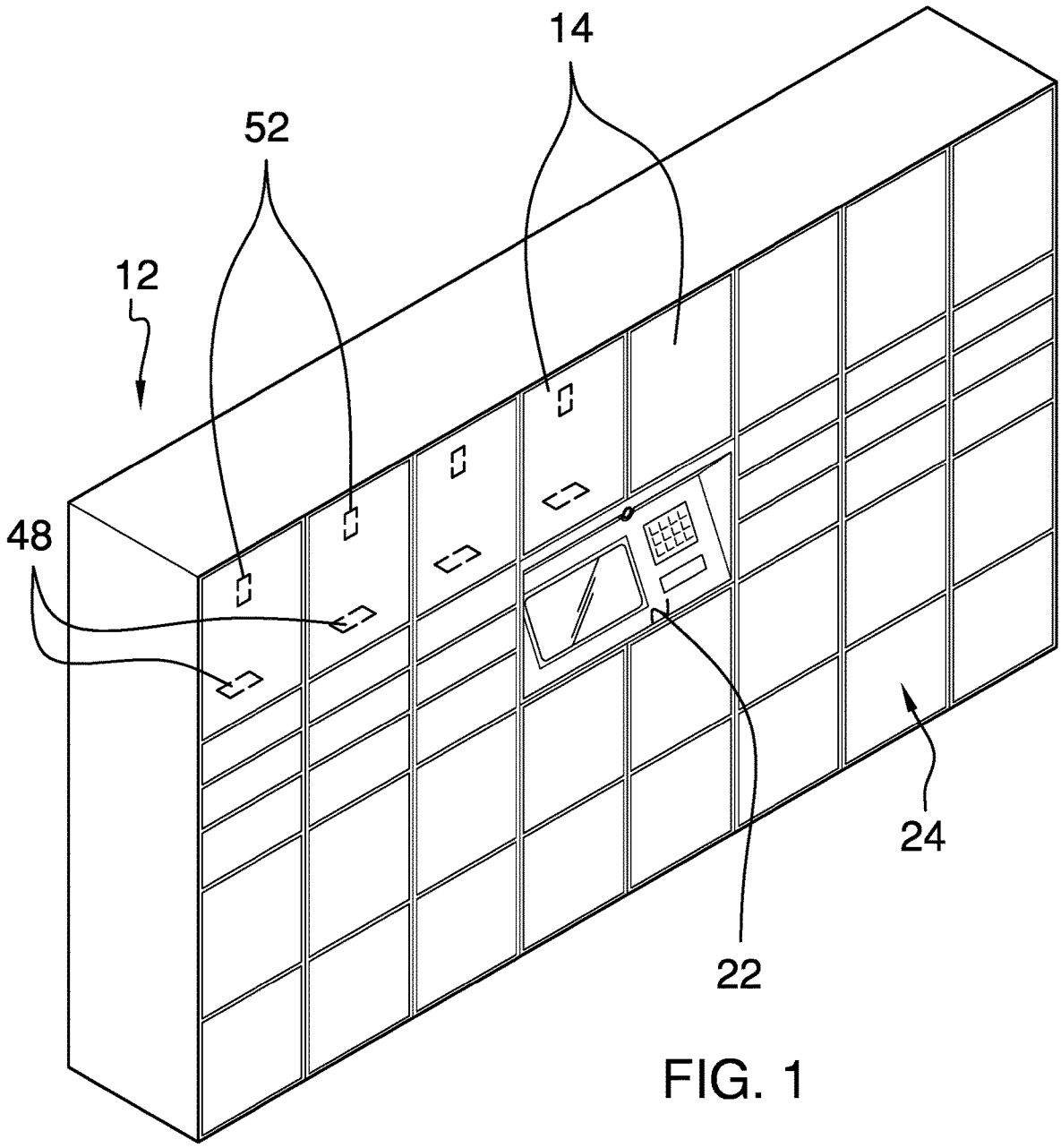
FIG. 1 is a front perspective view of a package storage assembly according to an embodiment of the disclosure.
Figure 2:
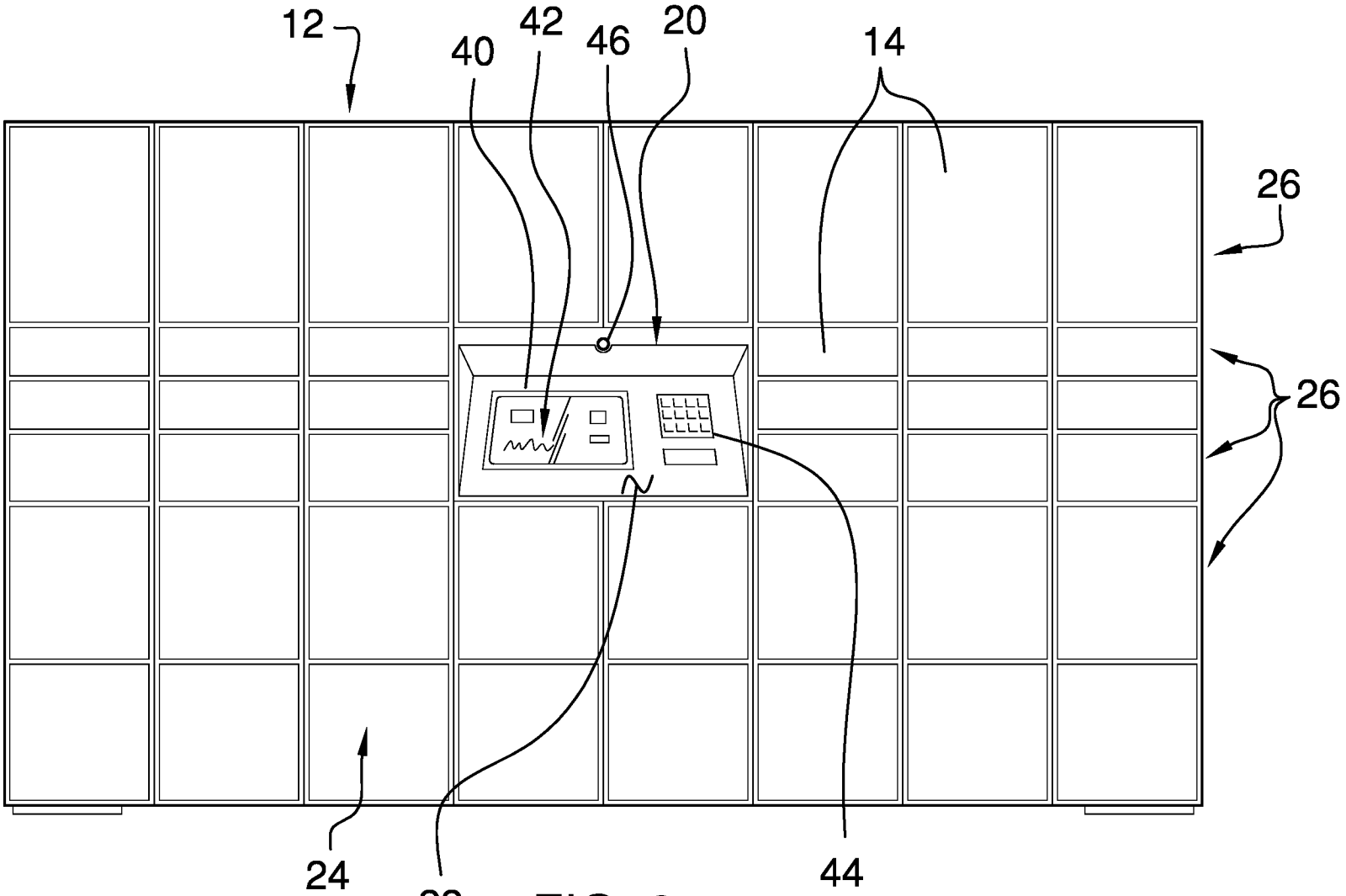
FIG. 2 is a front view of an embodiment of the disclosure.
Figure 3:
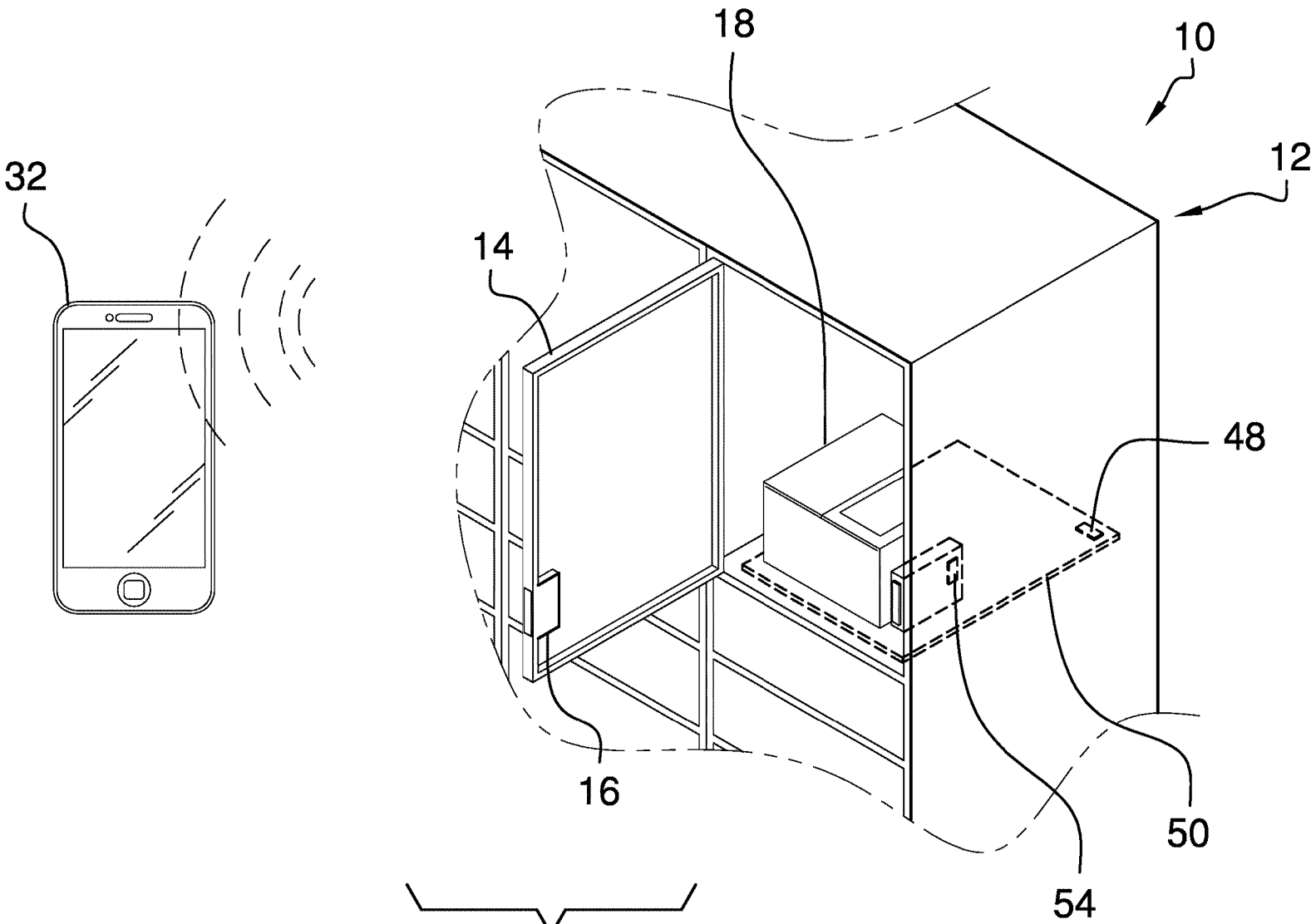
FIG. 3 is a perspective in-use view of an embodiment of the disclosure.
Figure 4:
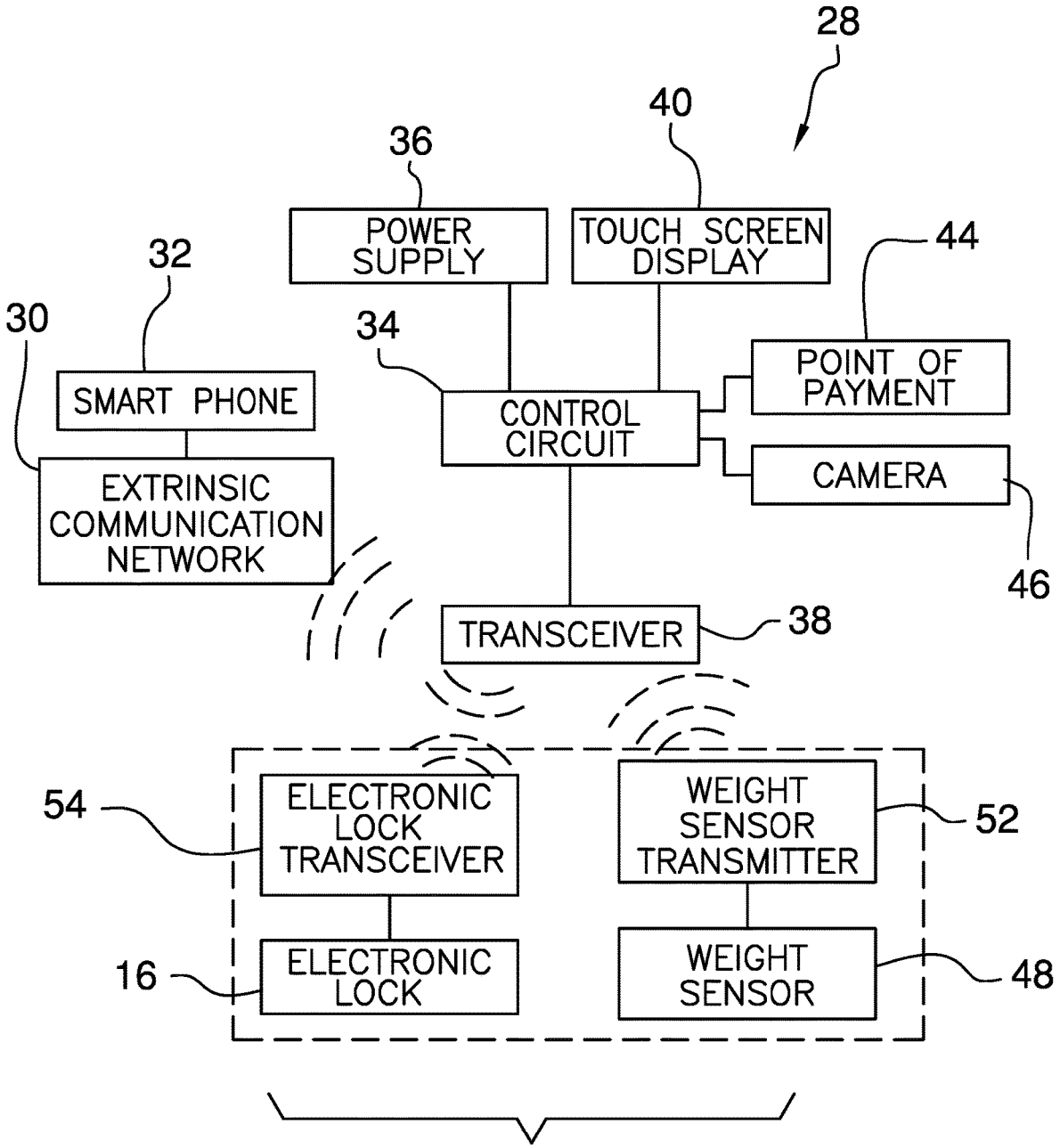
FIG. 4 is a schematic view of an embodiment of the disclosure.

With reference now to the drawings, and in particular to FIGS. 1 through 4 thereof, a new package storage device embodying the principles and concepts of an embodiment of the disclosure and generally designated by the reference numeral 10 will be described.

As best illustrated in FIGS. 1 through 4, the package storage assembly 10 generally comprises a battery of lockers 12 positioned in a public location such that the battery of lockers 12 is accessible to delivery drivers and intended recipients. Each of the battery of lockers 12 includes a door 14 and a lock 16 that integrated into the door 14 for locking the door 14 in a closed position. In this way the door 14 can secure a package 18 in a respective one of the battery of lockers 12. The battery of lockers 12 includes a control panel 20 that has an angled surface 22 which is integrated into a front face 24 of the battery of lockers 12 and the angled surface 22 lies on a plane which angles rearwardly from the front face 24. The control panel 20 is centrally positioned on the battery of lockers 12 and the door 14 associated with each of the battery of lockers 12 is positioned on the front face 24. The battery of lockers 12 includes a variety of sizes of lockers 12 that are arranged into a plurality of rows 26.

A communication unit 28 is integrated into the battery of lockers 12 and the communication unit 28 is in communication with the lock 16 in the door 14 associated with each of the battery of lockers 12. The communication unit 28 is in remote communication with an extrinsic communication network 30 thereby facilitating the communication unit 28 to be in communication a plurality of personal electronic devices 32. In this way the communication unit 28 can be in communication with the intended recipients. The extrinsic communication network 30 may be the internet, a cellular phone network or other type of wireless communication network and the plurality of personal electronic devices 32 may include smart phones or other electronic devices that have wireless communication capabilities. The communication unit 28 receives a delivery command from the extrinsic communication network 30 originating from a respective one of the plurality of personal electronic devices 32. Subsequently, the communication unit 28 assigns a respective one of the battery of lockers 12 to the respective personal electronic device 32. The communication unit 28 communicates an unlock code via the extrinsic communication network 30 to the respective personal electronic device 32 when the communication unit 28 receives the delivery command.

The communication unit 28 comprises a control circuit 34 is integrated into the battery of lockers 12. The control circuit 34 receives a lock input and an unlock input and the control circuit 34 is electrically coupled to a power source 36. The power source 36 may comprise an electrical system of a building adjacent to which the battery of lockers 12 is positioned or other source of continuous electrical power. The communication unit 28 includes a first transceiver 38 that is integrated into the battery of lockers 12 and the first transceiver 38 is electrically coupled to the control circuit 34. The first transceiver 38 is in wireless communication with the extrinsic communication network 30 such that the first transceiver 38 receives the delivery command from the extrinsic communication network 30. Additionally, the first transceiver 38 broadcasts the unlock code to the extrinsic communication network 30. The first transceiver 38 may comprise a radio frequency transceiver or the like and the first transceiver 38 may employ a WPAN signal or other type of conventional protocol that facilitates wireless communication on a public network.

The communication unit 28 includes a touch screen 40 that is integrated into the angled surface 22 of the control panel 20 such that the touch screen 40 is accessible to a user. The touch screen 40 is electrically coupled to the control circuit 34 and the touch screen 40 displays indicia 42 comprising a graphical user interface for the control circuit 34. The communication unit 28 includes a point of sale unit 44 that is integrated into the angled surface 22 of the control panel 20 such that the point of sale unit 44 is accessible to the user. The point of sale unit 44 is electrically coupled to the control circuit 34 and the point of sale unit 44 processes a payment for a respective one of the battery of lockers 12 thereby facilitating the respective one of the battery of lockers 12 to be assigned to an intended recipient. The touch screen 40 may comprise a light emitting diode screen or other type of electronic display and the point of sale unit 44 may include a keyboard and a card reader for reading forms of electronic payment.

The communication unit 28 includes a camera 46 that is integrated into the front face 24 of the battery of lockers 12 to capture footage of people employing the battery of lockers 12 and the camera 46 is electrically coupled to the control circuit 34. In this way the footage can be subsequently reviewed by law enforcement, for example, in the event of vandalism or theft. The camera 46 may comprise a digital video camera or other type of electronic camera.

A plurality of weight sensors 48 is provided and each of the plurality of weight sensors 48 is integrated into a respective of the battery of lockers 12 to sense the weight of a package 18 placed in the respective one of the battery of lockers 12. Each of the plurality of weight sensors 48 is positioned in a floor 50 of the respective one of the battery of lockers 12 and each of the weight sensors 48 is electrically coupled to the power source 36. Furthermore, each of the plurality of weight sensors 48 may comprise an electronic weight sensor or the like with a minimum weight sensitivity of approximately 15.0 grams.

A plurality of second transceivers 52 is included and each of the plurality of second transceivers 52 is integrated into a respective one of the battery of lockers 12 and each of the plurality of second transceivers 52 is electrically coupled to the weight sensor 48 in the respective one of the battery of lockers 12. Furthermore, each of the plurality of second transceivers 52 is in wireless communication with the first transceiver 38. The second transceiver 52 in a respective one of the battery of lockers 12 broadcasts a weight signal to the first transceiver 38 when the weight sensor 48 in the respective one of the battery of lockers 12 senses weight. Additionally, the control circuit 34 receives the lock input when the first transceiver 38 receives the weight signal from any of the plurality of second transceivers 52. Each of the plurality of second transceivers 52 is electrically coupled to the power source 36 and each of the plurality of second transceivers 52 may comprise a radio frequency transceiver or the like.

The lock 16 in the door 14 of each of the battery of lockers 12 includes a third transceiver 54 that is in wireless communication with the first transceiver 38. The third transceiver 54 in the lock 16 in the door 14 of a corresponding one of the battery of lockers 12 receives a lock command from the first transceiver 38 when the control circuit 34 receives the lock input as a result of the second transceiver 52 associated with the corresponding one of the battery of lockers 12 broadcasting the weight signal to the first transceiver 38. In this way the lock 16 in the door 14 of the corresponding one of the battery of lockers 12 can secure the package 18 that has been deposited in the corresponding one of the battery of lockers 12. The third transceiver 54 in the lock 16 in the door 14 of the corresponding one of the battery of lockers 12 receives an unlock command from the first transceiver 38 when the first transceiver 38 receives a pre-determined unlock code from an associated one of the plurality of personal electronic devices 32. In this way the lock 16 in the door 14 of the corresponding one of the battery of lockers 12 facilitates the intended recipient to retrieve the package 18 from the corresponding one of the battery of lockers 12.

In use, the battery of lockers 12 is positioned in a public area that is easily accessible to delivery drivers and intended recipients. The intended recipient employs a delivery application on their smart phone, for example, to order a locker 12 in the battery of lockers 12 and the first transceiver 38 communicates the unlock code to the intended recipient. Furthermore, the delivery driver is notified of which locker 12 has been ordered by the intended recipient to facilitate the delivery driver to deliver the package 18 to the locker 12 that was ordered. The weight sensor 48 senses the weight of the package 18 and the lock 16 on the door 14 of the locker 12 that was ordered is actuated to lock the door 14 once the door 14 is closed and the weight sensor 48 senses weight. In this way the door 14 on the locker 12 that was ordered cannot be opened until the unlock code is entered on the touch screen 40 on the battery of lockers 12 or if the unlock code is entered into the intended recipient's personal electronic device 32. In this way the intended recipient can retrieve their package 18 from the locker 12 that was ordered at any time that is convenient for them. Furthermore, the intended recipient can order a locker 12 with the touch screen 40 and pay for the locker 12 with the point of sale unit 44 rather than remotely ordering the locker 12 with their personal electronic device 32. Additionally, the intended recipient can enter the unlock code with the touch screen 40 to open the locker 12 that was ordered and retrieve their package.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A package storage assembly for facilitating a delivered package to be stored for subsequent retrieval by an intended recipient, said assembly comprising:

a battery of lockers being positioned in a public location wherein said battery of lockers is configured to be accessible to delivery drivers and intended recipients, each of said battery of lockers including a door and a lock integrated into said door for locking said door in a closed position wherein said door is configured to secure a package in a respective one of said battery of lockers; and a communication unit being integrated into said battery of lockers, said communication unit being in communication with said lock in said door associated with each of said battery of lockers, said communication unit being in remote communication with an extrinsic communication network thereby facilitating said communication unit to be in communication a plurality of personal electronic devices wherein said communication unit is configured to be in communication with the intended recipients, said communication unit receiving a delivery command from said extrinsic communication network originating from a respective one of said plurality of personal electronic devices, said communication unit assigning a respective one of said battery of lockers to said respective personal electronic device, said communication unit communicating an unlock code via said extrinsic communication network to said respective personal electronic device when said communication unit receives said delivery command.

2. The assembly according to claim 1, wherein said communication unit comprising:

a control circuit being integrated into said battery of lockers, said control circuit receiving an lock input and an unlock input, said control circuit being electrically coupled to a power source;

a first transceiver being integrated into said battery of lockers, said first transceiver being electrically coupled to said control circuit, said first transceiver being in wireless communication with said extrinsic communication network such that said first transceiver receives said delivery command from said extrinsic communication network, said first transceiver broadcasting said unlock code to said extrinsic communication network; and a camera being integrated into said front face of said battery of lockers wherein said camera is configured to capture footage of people employing said battery of lockers, said camera being electrically coupled to said control circuit.

3. The assembly according to claim 1, wherein:

said battery of lockers includes a control panel having an angled surface being integrated into a front face of said battery of lockers, said angled surface lying on a plane which angles rearwardly from said front face, said control panel being centrally positioned on said battery of lockers, said door associated with each of said battery of lockers being positioned on said front face;

said communication unit includes:

a control circuit being integrated into said battery of lockers;

a touch screen display being integrated into said angled surface of said control panel wherein said touch screen is configured to be accessible to a user, said touch screen being electrically coupled to said control circuit, said touch screen displaying indicia comprising a graphical user interface for said control circuit; and a point of sale unit being integrated into said angled surface of said control panel wherein said point of sale unit is configured to be accessible to the user, said point of sale unit being electrically coupled to said control circuit, said point of sale unit processing a payment for a respective one of said battery of lockers thereby facilitating said respective one of said battery of lockers to be assigned to an intended recipient.

4. The assembly according to claim 2, further comprising:

a plurality of weight sensors, each of said plurality of weight sensors being integrated into a respective of said battery of lockers wherein each of said plurality of weight sensors is configured to sense the weight of a package placed in said respective one of said battery of lockers, each of said plurality of weight sensors being positioned in a floor of said respective one of said battery of lockers, each of said weight sensors being electrically coupled to said power source; and a plurality of second transceivers, each of said second transceivers being integrated into a respective one of said battery of lockers, each of said plurality of second transceivers being electrically coupled to said weight sensor in said respective one of said battery of lockers, each of said plurality of second transceivers being in wireless communication with said first transceiver, said second transceiver in a respective one of said battery of lockers broadcasting a weight signal to said first transceiver when said weight sensor in said respective one of said battery of lockers senses weight, said control circuit receiving said lock input when said first transceiver receives said weight signal from any of said plurality of second transceivers, each of said plurality second transceivers being electrically coupled to said power source.

5. The assembly according to claim 4, wherein said lock in said door of each of said battery of lockers includes a third transceiver being in wireless communication with said first transceiver, said third transceiver in said lock in said door of a corresponding one of said battery of lockers receiving a lock command from said first transceiver when said control circuit receives said lock input as a result of said second transceiver associated with said corresponding one of said battery of lockers broadcasting said weight signal to said first transceiver wherein said lock in said door of said corresponding one of said battery of lockers is configured to secure the package.

6. The assembly according to claim 5, wherein said third transceiver in said lock in said door of said corresponding one of said battery of lockers receives an unlock command from said first transceiver when said first transceiver receives a pre-determined unlock code from an associated one of said plurality of personal electronic devices wherein said lock in said door of said corresponding one of said battery of lockers is configured to facilitate the intended recipient to retrieve the package from said corresponding one of said battery of lockers.

7. A package storage assembly for facilitating a delivered package to be stored for subsequent retrieval by an intended recipient, said assembly comprising:

a battery of lockers being positioned in a public location wherein said battery of lockers is configured to be accessible to delivery drivers and intended recipients, each of said battery of lockers including a door and a lock integrated into said door for locking said door in a closed position wherein said door is configured to secure a package in a respective one of said battery of lockers, said battery of lockers including a control panel having an angled surface being integrated into a front face of said battery of lockers, said angled surface lying on a plane which angles rearwardly from said front face, said control panel being centrally positioned on said battery of lockers, said door associated with each of said battery of lockers being positioned on said front face;

a communication unit being integrated into said battery of lockers, said communication unit being in communication with said lock in said door associated with each of said battery of lockers, said communication unit being in remote communication with an extrinsic communication network thereby facilitating said communication unit to be in communication a plurality of personal electronic devices wherein said communication unit is configured to be in communication with the intended recipients, said communication unit receiving a delivery command from said extrinsic communication network originating from a respective one of said plurality of personal electronic devices, said communication unit assigning a respective one of said battery of lockers to said respective personal electronic device, said communication unit communicating an unlock code via said extrinsic communication network to said respective personal electronic device when said communication unit receives said delivery command, said communication unit comprising:

a control circuit being integrated into said battery of lockers, said control circuit receiving an lock input and an unlock input, said control circuit being electrically coupled to a power source;

a first transceiver being integrated into said battery of lockers, said first transceiver being electrically coupled to said control circuit, said first transceiver being in wireless communication with said extrinsic communication network such that said first transceiver receives said delivery command from said extrinsic communication network, said first transceiver broadcasting said unlock code to said extrinsic communication network;

a touch screen display being integrated into said angled surface of said control panel wherein said touch screen is configured to be accessible to a user, said touch screen being electrically coupled to said control circuit, said touch screen displaying indicia comprising a graphical user interface for said control circuit;

a point of sale unit being integrated into said angled surface of said control panel wherein said point of sale unit is configured to be accessible to the user, said point of sale unit being electrically coupled to said control circuit, said point of sale unit processing a payment for a respective one of said battery of lockers thereby facilitating said respective one of said battery of lockers to be assigned to an intended recipient;

a camera being integrated into said front face of said battery of lockers wherein said camera is configured to capture footage of people employing said battery of lockers, said camera being electrically coupled to said control circuit;

a plurality of weight sensors, each of said plurality of weight sensors being integrated into a respective of said battery of lockers wherein each of said plurality of weight sensors is configured to sense the weight of a package placed in said respective one of said battery of lockers, each of said plurality of weight sensors being positioned in a floor of said respective one of said battery of lockers, each of said weight sensors being electrically coupled to said power source;

a plurality of second transceivers, each of said plurality of second transceivers being integrated into a respective one of said battery of lockers, each of said plurality of second transceivers being electrically coupled to said weight sensor in said respective one of said battery of lockers, each of said plurality of second transceivers being in wireless communication with said first transceiver, said second transceiver in a respective one of said battery of lockers broadcasting a weight signal to said first transceiver when said weight sensor in said respective one of said battery of lockers senses weight, said control circuit receiving said lock input when said first transceiver receives said weight signal from any of said plurality of second transceivers, each of said plurality of second transceivers being electrically coupled to said power source; and wherein said lock in said door of each of said battery of lockers includes a third transceiver being in wireless communication with said first transceiver, said third transceiver in said lock in said door of a corresponding one of said battery of lockers receiving a lock command from said first transceiver when said control circuit receives said lock input as a result of said second transceiver associated with said corresponding one of said battery of lockers broadcasting said weight signal to said first transceiver wherein said lock in said door of said corresponding one of said battery of lockers is configured to secure the package, said third transceiver in said lock in said door of said corresponding one of said battery of lockers receiving an unlock command from said first transceiver when said first transceiver receives a pre-determined unlock code from an associated one of said plurality of personal electronic devices wherein said lock in said door of said corresponding one of said battery of lockers is configured to facilitate the intended recipient to retrieve the package from said corresponding one of said battery of lockers.

* * * * *